US005444985A

United States Patent [19]

Lang et al.

[11] Patent Number: 5,444,985

[45] Date of Patent: Aug. 29, 1995

[54] CRYOGENIC TUNNEL FREEZER

[75] Inventors: Gary D. Lang; Walter C. Broderdorf, both of Wooster, Ohio; William M. Blumthal, Naperville, Ill.

[73] Assignee: Liquid Carbonic Corporation, Oak Brook, Ill.

[21] Appl. No.: 242,531

[22] Filed: May 13, 1994

[51] Int. Cl.[6] ..... F25D 13/06; F25D 17/02; F25D 25/04; F25D 3/12

[52] U.S. Cl. ..... 62/63; 62/374; 62/380; 62/388

[58] Field of Search ..... 62/63, 64, 374, 380, 62/388

[56] References Cited

U.S. PATENT DOCUMENTS

| | | | |
|---|---|---|---|
| 2,527,542 | 10/1950 | Gilson | 62/380 X |
| 3,122,897 | 3/1964 | Overbye | 62/275 |
| 3,226,947 | 1/1966 | Wakatsuki et al. | 62/380 X |
| 3,255,608 | 6/1966 | Macintosh | 62/374 |
| 3,267,585 | 8/1966 | Futer | 62/380 X |
| 3,287,932 | 11/1966 | Schlemmer, Jr. | 62/374 |
| 3,292,384 | 12/1966 | Rubin | 62/63 |
| 3,376,710 | 4/1968 | Hirtensteiner | 62/374 |
| 3,393,532 | 7/1968 | Khoylian | 62/380 |
| 3,402568 | 9/1968 | Kamin et al. | 62/380 |
| 3,403,527 | 10/1968 | Berreth et al. | 62/374 X |
| 3,404,989 | 10/1968 | Hirtensteiner | 99/193 |
| 3,427,820 | 2/1969 | Hart | 62/380 X |
| 3,455,120 | 7/1969 | Schlemmer | 62/380 X |
| 3,485,055 | 12/1969 | Webster et al. | 62/63 |
| 3,507,128 | 4/1970 | Murphy et al. | 62/63 |
| 3,553,973 | 1/1971 | Moran | 62/63 |
| 3,605,434 | 9/1971 | Boese | 62/374 |
| 3,613,386 | 10/1971 | Klee | 62/64 |
| 3,672,181 | 6/1972 | Tyree, Jr. | 62/63 |
| 3,688,518 | 9/1972 | Goltsos | 62/374 |
| 3,708,995 | 1/1973 | Berg | 62/63 |
| 3,757,533 | 9/1973 | Kent | 62/374 X |
| 3,772,898 | 11/1973 | Anderson | 62/380 X |
| 3,815,377 | 6/1974 | Tyree, Jr. | 62/62 |
| 3,841,109 | 10/1974 | Cann | 62/266 |
| 3,871,185 | 3/1975 | Harper et al. | 62/63 |
| 3,871,186 | 3/1975 | Wagner | 62/64 |
| 3,871,190 | 3/1975 | Harper et al. | 62/380 |
| 3,878,691 | 4/1975 | Asztalos | 62/62 |
| 3,882,687 | 5/1975 | Asztalos et al. | 62/64 |
| 3,892,104 | 7/1975 | Klee et al. | 62/380 X |
| 3,898,863 | 8/1975 | Wagner | 62/208 |
| 3,914,953 | 10/1975 | Miller | 62/380 X |
| 3,938,350 | 2/1976 | Martin et al. | 62/380 X |

(List continued on next page.)

FOREIGN PATENT DOCUMENTS

| | | |
|---|---|---|
| 0332287A1 | 9/1989 | European Pat. Off. . |
| 496675 | 7/1954 | Italy . |
| 121803 | 11/1958 | U.S.S.R. . |

OTHER PUBLICATIONS

"Cryo-Shield ® Liquid Carbonic Food Freezing Systems $CO_2$," 12 Page Brochure, Liquid Carbonic, Chicago, Ill., Form No. 6720, ©1981 Liquid Carbonic Corporation.

(List continued on next page.)

*Primary Examiner*—Christopher Kilner
*Attorney, Agent, or Firm*—Fitch, Even, Tabin & Flannery

[57] ABSTRACT

A tunnel freezer uses carbon dioxide snow to directly contact product carried on a conveyor belt passing through the freezer. Fans are provided above and below the upper conveyor belt run carrying the product, with the fans above and below having downwardly directed exhaust. Trough-shaped deflector plates are provided adjacent the lower fans to circulate a flow adjacent the underneath surface of the upper conveyor belt run. Preferably, circulation adjacent the upper conveyor belt run is generally parallel to the upper conveyor belt run, and turning vanes are provided to deflect the flow upwardly through the upper conveyor belt run. Freezers may be provided with one or more cooling zones arranged in series along the path of conveyor belt travel.

32 Claims, 8 Drawing Sheets

U.S. PATENT DOCUMENTS

| | | | |
|---|---|---|---|
| 3,960,206 | 6/1976 | Baxter et al. | 165/61 |
| 4,077,226 | 3/1978 | Strong | 62/380 X |
| 4,086,783 | 5/1978 | Wagner et al. | 62/374 |
| 4,086,784 | 5/1978 | Wagner | 62/374 |
| 4,127,008 | 11/1978 | Tyree, Jr. | 62/62 |
| 4,175,396 | 11/1979 | Miller et al. | 62/63 |
| 4,186,566 | 2/1980 | AuYoung | 62/380 |
| 4,229,947 | 10/1980 | Klee | 62/374 |
| 4,237,695 | 12/1980 | Oberpriller et al. | 62/63 |
| 4,276,753 | 7/1981 | Sandberg et al. | 62/186 |
| 4,333,318 | 6/1982 | Tyree, Jr. | 62/374 |
| 4,350,027 | 9/1982 | Tyree, Jr. | 62/374 |
| 4,399,658 | 8/1983 | Nielsen | 62/52 |
| 4,403,479 | 9/1983 | Rasovich | 62/63 |
| 4,475,351 | 10/1984 | Klee | 62/63 |
| 4,481,782 | 11/1984 | Mukerjee | 62/63 |
| 4,528,819 | 7/1985 | Klee | 62/63 |
| 4,589,264 | 5/1986 | Åström | 62/374 |
| 4,739,623 | 4/1988 | Tyree, Jr. et al. | 62/63 |
| 4,757,691 | 7/1988 | Compagnon | 62/63 |
| 4,783,972 | 11/1988 | Tyree, Jr. et al. | 62/374 |
| 4,803,851 | 2/1989 | Stokes | 62/374 |
| 4,852,358 | 1/1989 | Acharya | 62/63 |
| 4,866,946 | 9/1989 | Klee | 62/63 |
| 4,912,943 | 4/1990 | Hubert et al. | 62/374 |
| 4,914,927 | 4/1990 | Miller et al. | 62/381 |
| 5,018,438 | 5/1991 | Grandi | 99/335 |
| 5,054,292 | 10/1991 | Klee | 62/63 |
| 5,123,261 | 6/1992 | Cope | 62/374 |
| 5,168,711 | 12/1992 | Moore et al. | 62/63 |
| 5,365,752 | 11/1994 | Coffre | 62/374 |

OTHER PUBLICATIONS

"Ultra-Freeze® can boost your profits," 4 page brochure with insert pp. 1-6, Cardox® Division of Chemetron Corporation, Countryside, Ill., Form No. B-1, ©1978 Chemetron Corporation.

CRYOGENIC TUNNEL FREEZER

BACKGROUND OF THE INVENTION

1. Field of the Invention

The present invention pertains to cryogenic freezers, and in particular to tunnel freezers wherein a conveyor belt carrying product passes through an elongated tunnel-shaped freezer, with frozen, partially frozen, or cooled product emerging at the exit end of the freezer.

2. Description of the Related Art

Improvements have been sought for so-called cryogenic tunnel freezers, especially such freezers employing carbon dioxide "snow" as a cooling media. Although a variety of different fan configurations have been employed within the tunnel freezers for distributing the carbon dioxide snow, difficulties have been encountered from time to time in operating prior art freezers, especially at high cryogen input levels over long periods of time. It is particularly desirable that the environment within a tunnel freezer be isolated from the ambient to avoid adding to the heat and moisture loads carried by product being processed, (i.e., chilled or frozen) by the freezer apparatus. After prolonged operation, significant quantities of carbon dioxide snow are generated in the freezer interior. Fans within the freezer are provided to circulate the carbon dioxide snow, but over time, increasing amounts of carbon dioxide snow come out of circulation, becoming trapped within various parts of the freezer interior. If excessive amounts of snow or liquid are allowed to accumulate in the freezer interior circulation may be reduced, and free movement of equipment within the freezer may become impaired. Given the substantial amount of down time which may be required to service a freezer during a prolonged production run, further improvements in freezer performance are being sought.

SUMMARY OF THE INVENTION

It is an object according to the present invention to provide a tunnel freezer for treating product with solid or liquid cryogen particles such as carbon dioxide "snow".

Another object according to the present invention is to provide a tunnel freezer of the above-described type, having a plurality of cooling zones throughout its length.

Yet another object according to the principles of the present invention is to provide a tunnel freezer of the above-described type having multiple fans for each cooling zone.

These and other objects according to the principles of the present invention are provided in freezer apparatus, comprising a tunnel enclosure;

a perforate conveyor belt for transporting products, having at least an upper conveyor belt run and extending through the tunnel enclosure;

an upper fan in the tunnel enclosure above the upper conveyor belt run and having a downward discharge directed toward the upper conveyor belt run;

spray means in the tunnel enclosure above the upper conveyor belt run, for spraying solid or liquid particles of heat transfer material onto products carried on the upper conveyor belt run;

a lower fan in the tunnel enclosure below the upper conveyor belt run and having a downward discharge directed away from the upper conveyor belt run;

a curved deflector member located below the lower fan, directing at least a portion of the discharge of the lower fan along the underside of the upper conveyor belt run; and a turning vane means located below the upper conveyor belt run for directing the portion of the discharge of the lower fan flowing along the underside of the upper conveyor belt run in a generally upward direction.

DETAILED DESCRIPTION OF THE PREFERRED EMBODIMENTS

Figure 1:
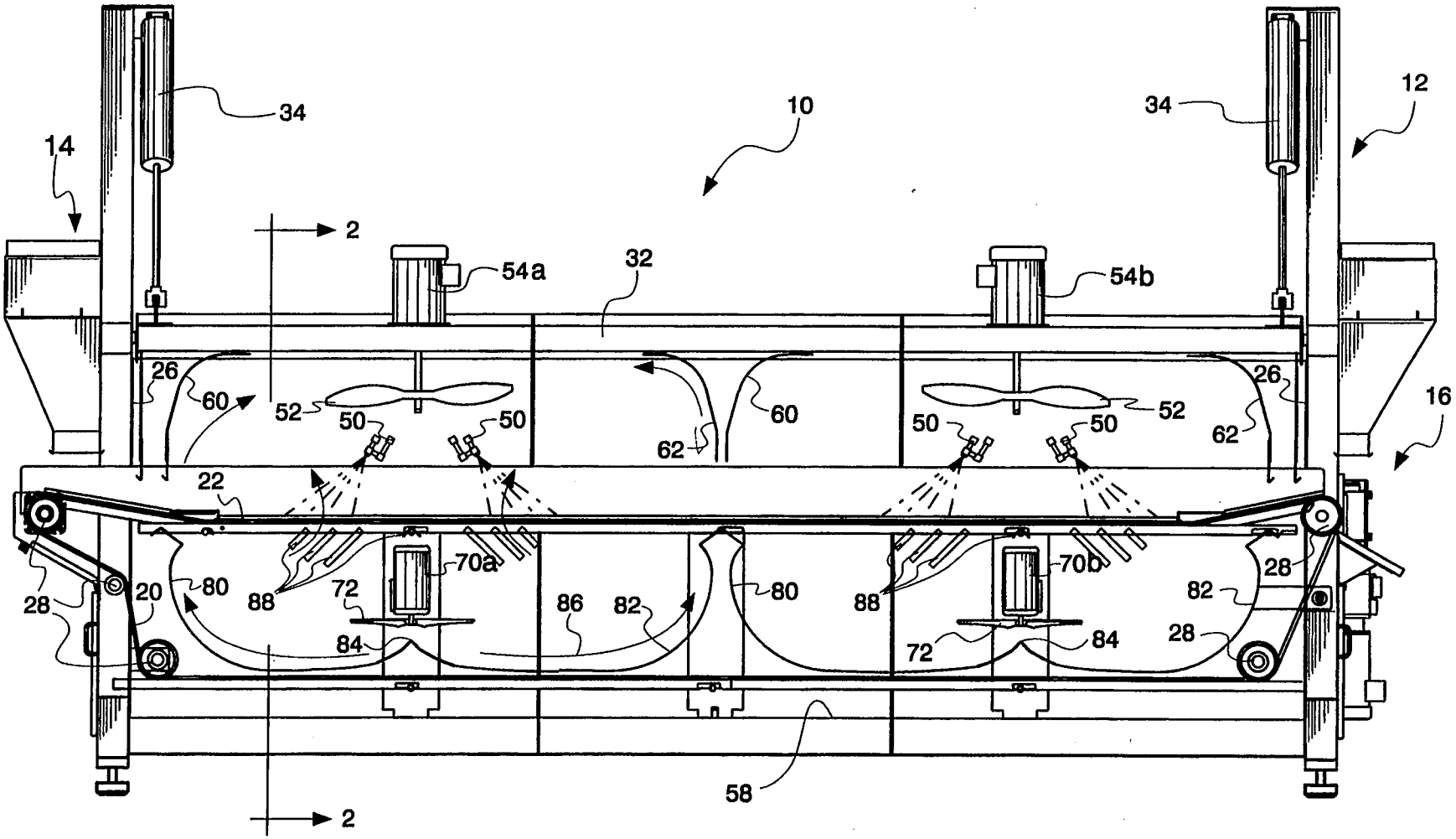
FIG. 1 is a side elevational view of a freezer constructed according to principles of the present invention.
Figure 2:
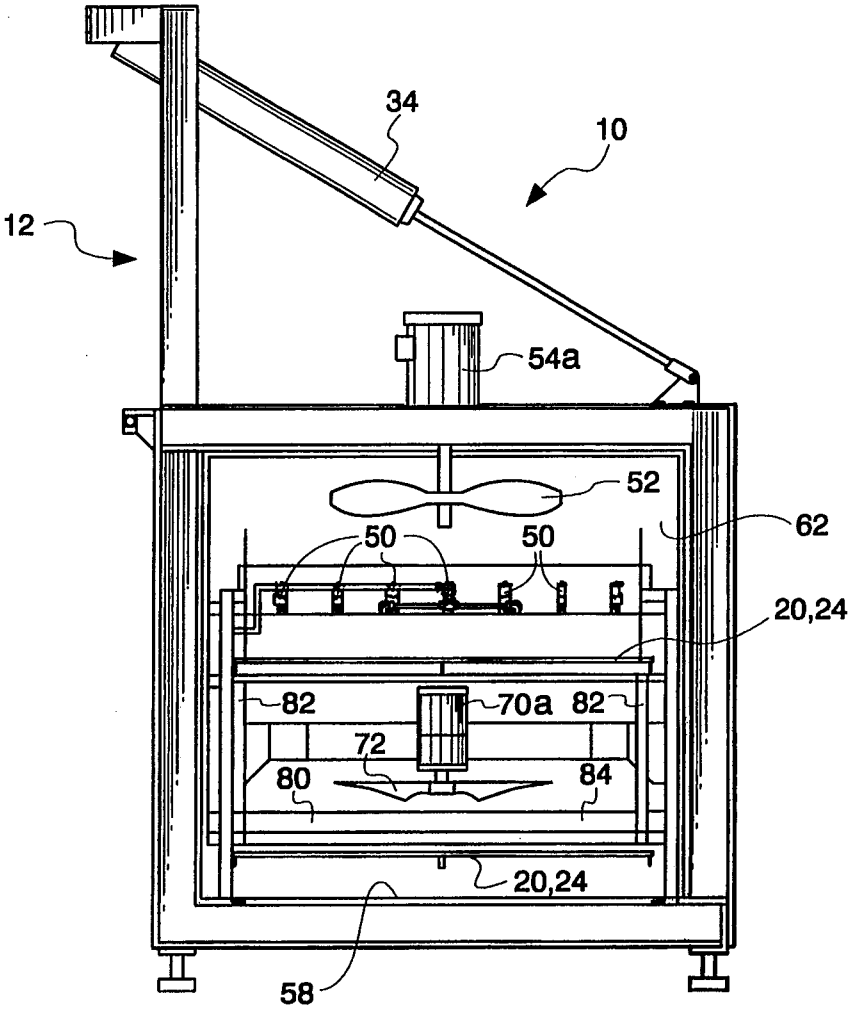
FIG. 2 is a cross-sectional view thereof, taken along the lines 2—2 of FIG. 1.

Referring now to the drawings, and initially to FIGS. 1 and 2, a freezer generally indicated at 10 includes a housing generally indicated at 12, includes an entrance end 14 and an exit end 16. A conveyor belt 20 preferably comprises and endless loop having an upper belt run 22 and a lower belt run 24. The conveyor belt could also have a single run, and need not be in the form of an endless loop. In the preferred embodiment, conveyor belt 20 is perforate so as to allow the cooling spray injected from nozzles 50 to pass through the conveyor belt, and particularly the upper belt run 22. Flexible curtains or barriers 26 block the entrance and exit ends of the conveyor. The conveyor belt 20 is supported by a plurality of rollers 28, positioned so as to space the belt runs 22, 24 apart from one another. The housing 12 includes a movable cover 32 supported by hydraulic pneumatic or other type of actuating pistons 34 so as to be movable between the closed position illustrated in the figures, and an open position for servicing the interior of the freezer.

The interior of freezer 10 is preferably cooled using a cryogenic media such as carbon dioxide, which is relatively inexpensive and readily available in the quantities needed for large-scale production. The carbon dioxide is preferably supplied in liquid form, maintained under pressure, the released to the freezer through expansion valves, such as Praso (Pressure Responsive, Automatic Shut Off) valves indicated at 50. A directed stream of carbon dioxide snow is emitted under pressure at the outlet of each valve 50. Preferably, the valves are movably mounted so as to redirect the discharge in different directions as required for different freezer operations.

As shown in FIG. 1, the valves 50 are located directly below fan blades 52. The fan blades 52 are preferably driven by motors 54*a*, 54*b* located outside of the freezer housing, which drive the blades in a direction for downward discharge toward the floor 58 of the freezer housing. The valves 50 need not be located directly underneath the blades 52, i.e. directly underneath the path of travel of the fan blades, and it should be realized that the exact positioning of the valves will vary from one installation to another. However, it is preferred that the valves 50 be located between fan blades 52 and the upper run 22 of conveyor belt 20.

The freezer 10 shown on pages 1 and 2 has two cooling zones arranged in series with respect to the direction of belt travel. The present invention contemplates any number (i.e., one or more) of cooling zones that may be desired. In the preferred embodiment, the two cooling zones are preferably identical, although they need not be. For example, each cooling zone includes an upstream curtain 60 and a downstream curtain 62 located adjacent the fan blades 52. The curtains 60, 62 are preferably concave when viewed from below and open in a downward direction. In other embodiments, the curtains need not be concave and in certain circumstances they can be omitted if desired.

As mentioned, external upper fan drive motors 54 are provided, one for each cooling zone. The upstream cooling zone has a fan drive motor 54*a*, whereas the downstream cooling zone has a fan drive motor 54*b*. The upstream curtain 60 for the upstream cooling zone and the downstream curtain 62 of the downstream cooling zone could be located away from cover 32 so as to remain stationary as cover 32 is raised by operation of pistons 34. However, it is preferred that the curtains be carried by the cover 32 for easy servicing. By attaching flow channeling components to cover 32 in association with drive motors 54 and fan blades 52, easy modification of the freezer components is made possible and access for washdowns, and for any troubleshooting or evaluation which may become necessary throughout the life of the freezer is greatly improved. The curtains 60, 62 associated with each cooling zone help to define the pattern of vapor flow generated by the fan blades 52. However, as can be seen in FIG. 1, for example, the downwardly pointed valves 50 are located toward the bottom edges of the curtains 60, 62. Thus, the curtains do not play a substantial role in directing the snow which has just been emitted from the valves 50. As will be seen herein, the snow or liquid is circulated within a cooling zone and, after traveling a carefully controlled flow path a portion of the snow or liquid is returned to the upper part of the freezer so as to be guided by the curtains 60, 62.

As mentioned above, it is generally preferred that the conveyor belt 20 be of perforate construction so as to allow the cooling spray from nozzles 50 to pass through the conveyor belt toward floor 58 of the freezer. Attention will now be directed to circulation equipment located below the upper belt run. Motors 70*a*, 70*b*, are provided for the two cooling zones of freezer 10. The motors drive fan blades 72 and are located between the upper conveyor run 22 and the floor 58 of the freezer, and preferably between the upper and lower runs 22, 24 of conveyor belt 20. Upstream and downstream deflector panels 80, 82 are also provided for each cooling zone. The deflector panels form a generally concave trough-like configuration when viewed from above, with the axis of the trough lying generally perpendicular to the direction of belt travel. The deflector plates 80, 82 of a cooling zone preferably meet at a cusp 84, passing through the axis of the fan motors 54 or 70.

As indicated by arrows in FIG. 1, the fan motors 70 drive the fan blades 72 in a direction for a downwardly directed discharge, against the deflector panels 80, 82, at points adjacent the cusp 84. A single flow line 86 is illustrated in the left half of FIG. 1, showing discharge of fan blades 72 against deflector panel 82. The flow line is initially oriented parallel to the shaft of motor 70, but is quickly turned by portions of deflector panel 82 adjacent cusp 84 into a generally horizontal path.

After following the generally planar bottom portion of the deflector panel 82, flow line 86 is then turned in an upward direction by the concave sidewall portions of deflector panel 82, whereby it develops both a vertical and horizontal flow component. The vertical flow component passes through the perforated belt, thereby contacting and cooling the lower product surfaces. The horizontally directed flow component travels parallel to the belt path,contacting turning vanes 88, whereby the flow path is redirected vertically (or angularly thereof), through the perforated belt, whereby the lower product surface is contacted and cooled. Sets of turning vanes 88 are therefor provided below the upper conveyor run 22. The turning vanes 88 extend in a downward direction and, with respect to the center line of the motors 54, 70, the turning vanes 88 also extend in a generally outward direction. In the preferred embodiment, the turning vanes have a generally planar plate-like configuration, although other configurations are also possible. The turning vanes are pivotally mounted so as to be readily reconfigurable for different freezer flow conditions. Preferably, the vanes are mounted for individual movement, although they could be ganged together, if desired. As indicated by the flow line 86 in FIG. 1, the turning vanes 88 deflect flow output of fan blades 72 in an upward direction, so as to impinge upon the bottom surface of product carried on the upper belt run 22.

If the upper belt run has a relatively low density loading, a significant portion of the snow or liquid deflected by turning vanes 88 will pass in an upward direction above the upper conveyor run 22. Snow or liquid traveling along this portion of the flow path will intersect the output of valves 50 as well as the vapor currents from upper fan blades 52 so as to travel in a downward and outward direction with substantial velocity toward the upper surface of the product carried on belt 20. The impingement velocities of snow or liquid deflected by turning vanes 88 and added to snow or liquid directed onto passing above the upper conveyor run 22 are believed to be of substantial magnitude so as to contribute an added effective cooling of the product upper surface.

Figure 3:
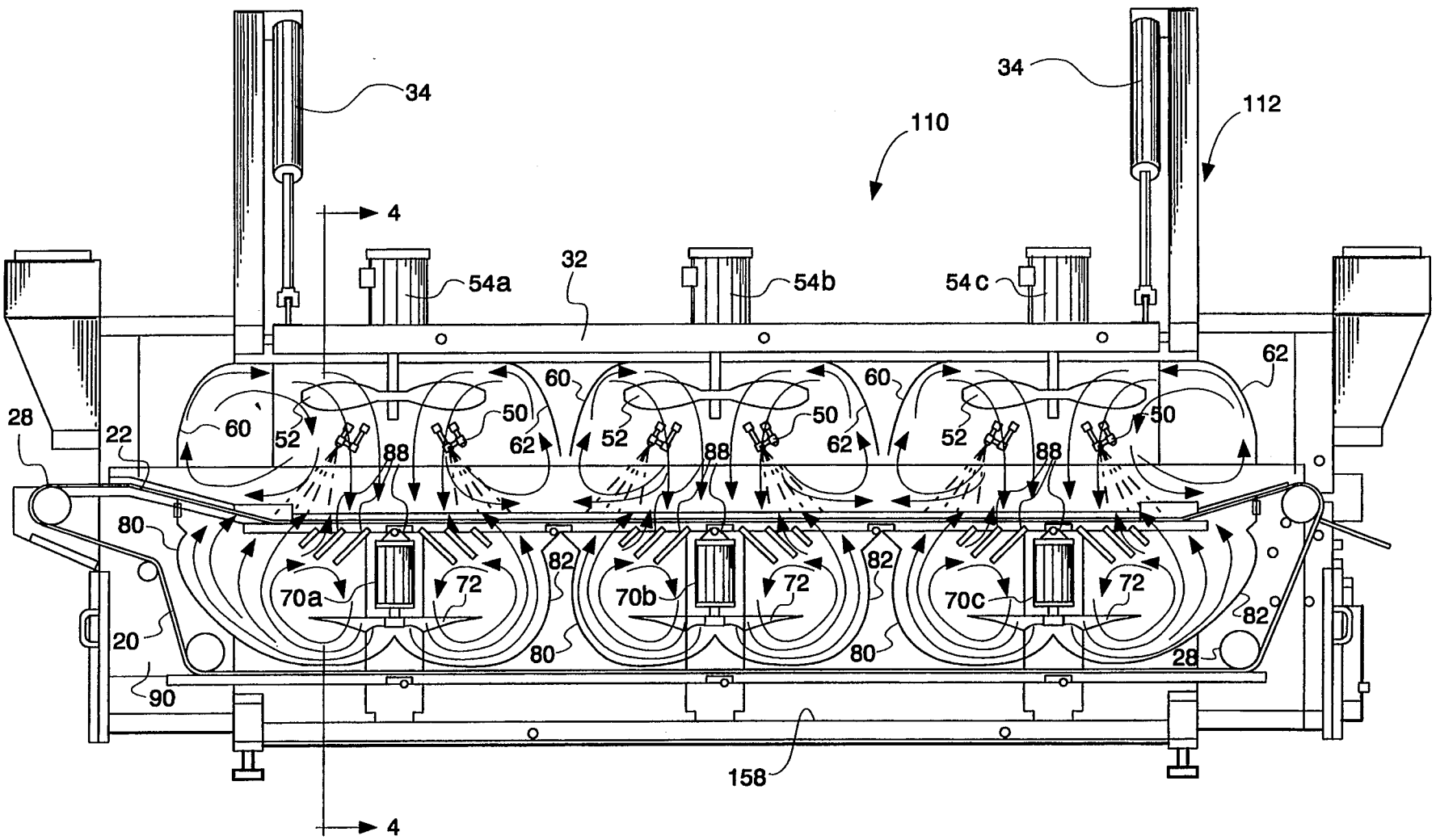
FIG. 3 is a side elevational view of an alternative embodiment of a tunnel freezer, illustrating principles of the present invention.

Snow which does not sublime, is carried along with snow freshly injected from nozzles 50 in the direction illustrated by the flow line, upwardly along skirt 62. The upper portion of curtain 62 is a relatively low pressure region within the freezer, and snow or liquid particles located in that vicinity are quickly picked up by the suction created by fan blades 52. As will be seen later, a second embodiment of the present invention is shown in FIG. 3 with a third cooling zone. A more complete set of flow lines is shown in FIG. 3 and the flow lines for any of the cooling zones of FIG. 3 would be the same for the dual cooling zones of FIG. 1.

Figure 4:
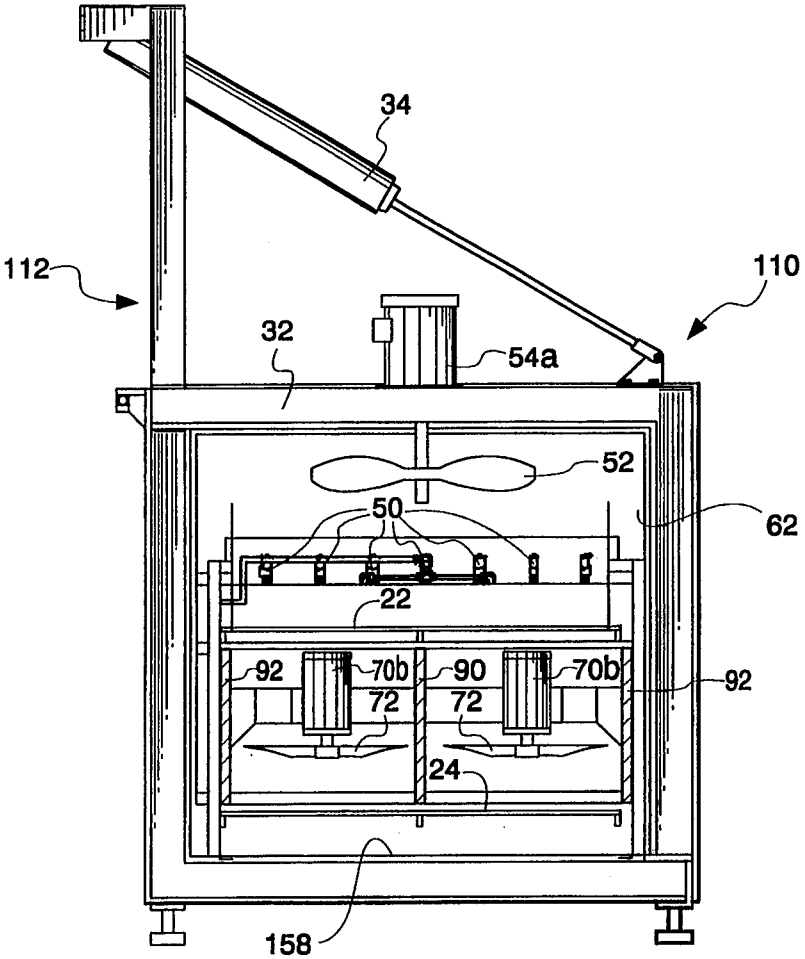
FIG. 4 is a cross-sectional view taken along the lines 4—4 of FIG. 3.

Turning now to FIGS. 3 and 4, a second embodiment of a freezer according to principles of the present invention is generally indicated at 110. The freezer 110 is substantially identical to freezer 10, except for the addition of a third cooling zone, and except for the dual bottom fans for each of the cooling zones, as can be seen in FIG. 4.

Referring now to FIG. 3, the upper fan blades 52 have a downwardly directed discharge. In the preferred embodiment, the nozzles 50 are located underneath the fan blades, although they could be located outside of the fan blades, if desired, for a particular freezer configuration. In the preferred embodiment illustrated in FIG. 3 (as is also true in FIG. 1), the nozzles 50 are positioned so that snow injected from the nozzles impacts product on upper belt run 22 with a maximum impingement velocity. The nozzles 50 are placed with respect to fan blades 50 so that impingement velocity is not substantially impaired by the vapor flow circulated by fans 52. As with other embodiments described herein, the freezer 110 can be employed to cool rather than freeze product, and can be used alone or in combination with other types of equipment, such as mechanical freezers, for example.

Disposition of snow injected by nozzles 50 depends in part upon the loading density of upper belt run 22. If the upper belt run is densely loaded, snow is entrained in the vapor flow set-up across curtains 60, 62. If, however, the upper belt run is loaded with a lower density, i.e., with a greater spacing between product portions, snow or liquid entrained in the output flow of blades 52 passes downwardly through the upper run 22 of the conveyor belt, passing into the low pressure or suction side of the lower fan blades 72.

As in the preceding embodiment illustrated in FIGS. 1 and 2, circulating snow or liquid exiting blades 72 passes in a generally horizontal direction, parallel to the floor 158 of freezer 110. The circulating snow or liquid is then deflected along the sidewalls of deflector panels 80, 82 whereby it develops both a vertical and horizontal flow component. The vertical flow component passes through the perforated belt, thereby contacting and cooling the lower product surfaces. Upon contact of the horizontal flow component with turning vanes 88, Upon contact with turning vanes 88, the circulating snow or liquid is deflected to either impinge the lower side of a product carried on the upper belt run, or if the spacing between product portions is substantial, the circulating snow or liquid is deflected upwardly where it meets the flow exiting from the upper blades 52, becoming mixed with snow freshly injected from nozzles 50. Due to the velocity of snow particles injected from nozzles 50, and due to the velocity imparted by the motion of fan blades 52, the snow or liquid particles impinge upon product carried on upper belt run 22, or are deflected by curtains 60, 62 so as to enter the lower pressure side of fan blades 52, to repeat travel through the freezer.

Referring to FIG. 4, it can be seen that a pair of lower fan motors and blades are provided in each cooling zone. The dual, lower fan arrangement may also be employed in tunnel freezers having differing numbers of cooling zones, for example, the dual cooling zone freezer illustrated in FIG. 1. It is generally desirable when multiple lower fans are used, that the output flows of each fan be isolated by a central baffle plate 90 and outer baffle plate 92. In the preferred embodiment, the baffle plates 90, 92 are generally planar, although other configurations could be used if desired. For example, the baffle plates 90, 92 can be combined with the deflector plates 80, 82 to form a generally concave bowl surrounding the lower fan blades 72.

As mentioned above, the deflector panels 80, 82 are configured so as to set up a substantial, generally horizontal directed flow component adjacent the underside of upper belt run 22. The horizontal flow component below the upper belt run is generally desired, although this feature may be omitted in certain circumstances, with the flow sweeping across deflector plates 80, 82 passing in a generally upward direction, without requiring the turning vanes 88.

As indicated in FIG. 3, a small component of the flow patterns above and below the upper belt run traverse a generally poloidal path which has been found effective in certain circumstances for effective sweeping of certain low pressure "corners" within a cooling zone. The poloidal flow components above and below the upper belt run could be significantly reduced or eliminated if desired, for freezer configurations found not to require the additional "cleaning" action.

An important advantage of freezers constructed according to the present invention is that snow or liquid is not accumulated within the cooling zones of the freezer, that is, the flow-confining surfaces of a cooling zone are continuously wiped clean with the flow patterns set up within each cooling zone. In fact, it has been found that cryogen input can be increased beyond what is normally expected in similarly sized tunnel freezers and the circulation within the cooling zones has been found to maintain suspension of significantly higher snow or liquid loadings than heretofore possible. A further advantage of freezers constructed according to the present invention is that the impingement velocities of snow or liquid particles on product to be cooled are maintained at significantly high levels so as to contribute substantially to high efficiency, high heat transfer rates, even for relatively high temperature/high moisture content products. With freezers constructed according to the present invention, more snow or liquid can be generated within the freezer without risk of clogging the freezer due to snow or liquid accumulation.

Another important advantage of freezers constructed according to the present invention is that higher snow or liquid loadings can be maintained within the freezer, despite varying product throughput. For example, higher cryogen levels can be maintained through a wide variety of product densities being carried on upper belt run 22. When the upper belt run is loaded with a high density, and relatively little or no spacing between product portions, the upper conveyor belt run 22 effectively divides the freezer into upper and lower portions. In these operating conditions, the upper fans have been found to provide highly efficient heat transfer, even at heat transfer rates higher than those normally encountered in tunnel freezers. At the same time, the lower fans have been found to have high-efficiency, high-heat transfer rates, even though significant flows are not allowed through the upper conveyor belt run. On the other hand, freezers constructed according to principles of the present invention have been found to provide consistently high efficiency, high heat transfer rates when the upper belt run is lightly loaded (when greater spacings between adjacent product portions allow increased flows through the upper conveyor belt run). In light loading conditions, the upper and lower fans (whether single or dual lower fans are provided) have been found to complement one another, with interference between the flows of different fans being reduced or substantially eliminated. Whether the upper belt run is lightly or heavily loaded, accumulation of snow or liquid within the freezer is avoided with the present invention, even for higher cryogen inputs than would be expected for similarly sized tunnel freezers.

The curtains 60, 62 have been found to provide enhanced operation under certain operating conditions and are believed to be effective in defining desirable flow paths, while reducing destructive interference between adjacent fans. However, it is recognized that the curtains 60, 62 could be eliminated in certain operating conditions, depending upon the relative size, spacing, pitch and shape of adjacent fan blades 52 and their spacing relative to each other and to the walls of the freezer housing.

Figure 5:
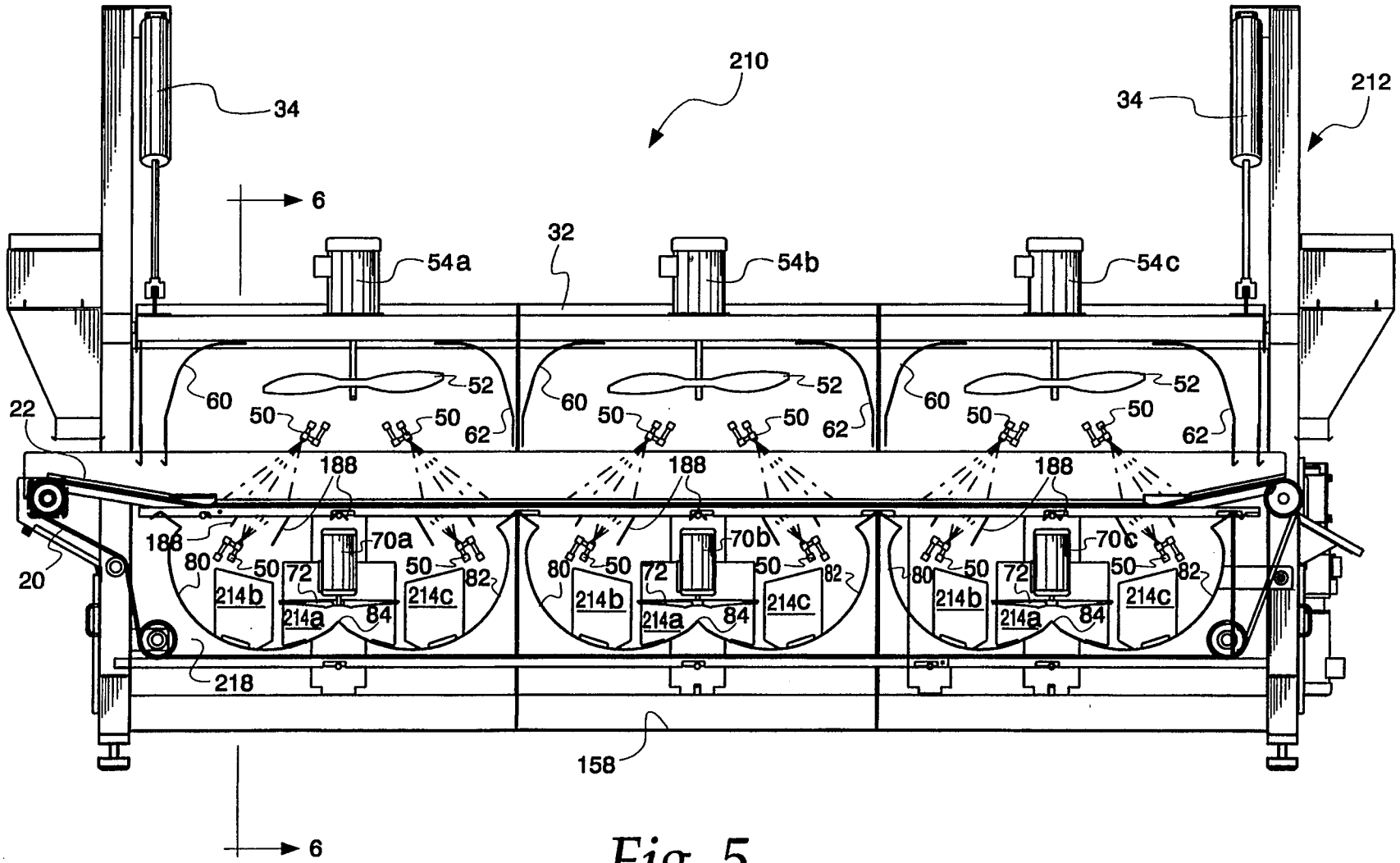
FIG. 5 is a side elevational view of another alternative embodiment of a tunnel freezer, illustrating principles of the present invention.
Figure 6:
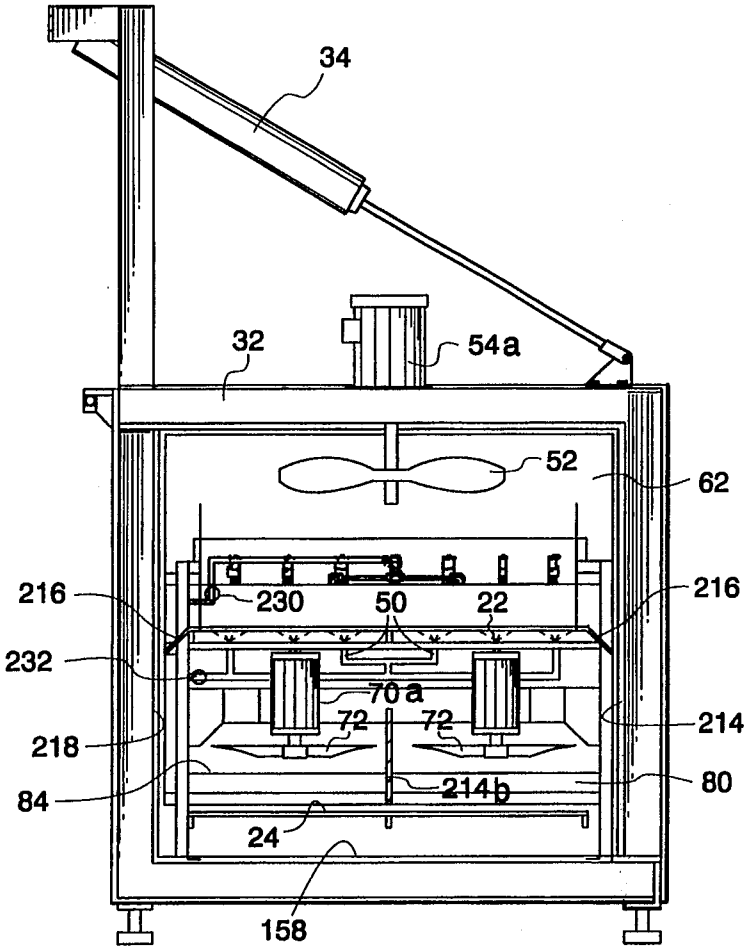
FIG. 6 is a cross-sectional view taken along the line 6—6 of FIG. 5.

Referring now to FIGS. 5 and 6, an alternative embodiment according to principles of the present invention is generally indicated at 210. The freezer 210 has a housing 212 substantially identical to housing 112 described above, except that the central baffle located below the upper run of conveyor belt 20 is reduced in size, and has a segmented construction. The central baffle plates in each of the three cooling zones of freezer 210 include a central baffle segment 214*a* located between a pair of outlying baffle segments 214*b*, 214*c*. The central baffle plate 214*a* is of generally rectangular configuration, except that its bottom portion, conforms to the cusp 84 formed between deflector panels 80, 82. Referring to FIG. 6, relatively small side panels 216 are located on either side of the upper run 22 of conveyor 20, and close the gap between the upper conveyor run and sidewalls 218 of the freezer cabinet.

As with the preceding freezer illustrated in FIGS. 3 and 4, the freezer 210 has a series of baffle plates 188 disposed below the upper conveyor run to deflect snow or liquid circulated across deflector panels 80, 82 in an upward direction, against the underside of product carried on conveyor 20.

As mentioned above, the various embodiments of freezers constructed according to principles of the present invention have been found to continuously offer a dual mode operation, without requiring reconfiguration of the freezer components. For example, when a conveyor is lightly loaded, snow or liquid is circulated between the upper and lower parts of each cooling zone, passing through the upper conveyor run 22. The turning vanes 188 play a role in this mode of operation, to pass snow or liquid from the lower part of the cooling zone to the upper part. However, when the upper belt run is densely loaded with product, circulation through the upper belt run is greatly reduced and at times is substantially blocked. In this separated flow mode of operation, the upper and lower parts of each cooling zone, i.e., the parts above and below the upper conveyor run 22, function independently of one another, with snow or liquid circulated by upper fan 52 impinges on the upper side of products carried on the upper belt run. Snow which is not sublimed is circulated in the upper part of the cooling zones due to the flow pattern set up. In the preferred embodiments, the curtains 60, 62 provide an optional enhancement of the flow in the upper part of the cooling zone. During separated flow mode, snow or liquid which has previously passed through the upper belt run is trapped within the lower part of the cooling zone and is circulated by the lower fans 70, which sweep clean the deflector panels 80, 82 to deliver a maximum snow or liquid loading to the underside of product carried on conveyor 20.

In addition to the different modes of freezer operations described above, product density may vary over time along the upper conveyor belt run. For example, spaced apart groups of tightly packed product may be loaded on the upper belt run, with snow or liquid passing between the product groupings to pass into the lower part of the cooling zones. However, at other times the upper belt run may be continuously loaded with a high density of product, with little or no spacing between product portions. Under either condition, the lower part of each cooling zone will eventually run short of snow or liquid needed to maintain desired heat transfer rates. In these circumstances, it is preferred that a second set of Praso valves 50 be located below the upper run 22 of conveyor belt 20, as illustrated in FIG. 5. The lower valves 50 are preferably located between turning vanes 188 so as to inject snow directly toward the underside of upper belt run 22. In the preferred embodiment, the lower valves 50 are closely spaced with respect to the upper conveyor run 22. According to one aspect of the present invention, the lower valves 50 may be operated at surprisingly high cryogen input levels, since the circulation pattern set up within the cooling zones is able to sustain continuous cryogen circulation in the lower part of each cooling zone, preventing snow or liquid from building up in the vicinity between the turning vanes, or indeed, virtually all other parts of the freezer located below the upper conveyor run 22.

A further advantage enjoyed by freezers constructed according to principles of the present invention is that upper and lower Praso valves can be continuously operated throughout a wide range of upper belt run loadings, and in general, much higher cryogen input rates can be sustained under widely varying conditions because the flow patterns set up within each cooling zone, whether separated by high belt densities or not, maintain build-up free circulation of snow or liquid within the freezer. Referring again to FIG. 6, valves 230, 232 can be installed in the cryogen lines for the upper and lower Praso valves, respectively. The valves 230, 232 can be continuously varied, if desired, to achieve a greater variation in freezer operation. This, however, is optional and has not been found to be necessary in existing installations.

The varying cryogen flows described above can be used in combination with other freezer controls. For example, the product density on the belt can be controlled, as well as belt speed. In addition, the speeds of the fan motors 54, 70 and the configuration of the fan blades 52, 72 can be altered as desired to achieve a wide range of flow conditions within each cooling zone. As mentioned, the turning vanes 188 may be relocated to various points under the top conveyor belt run, and the turning vanes are preferably pivotally mounted so that their directions may be changed for optimum performance during different flow conditions within a cooling zone. Of course, the cooling zones for a particular freezer can be operated differently, if desired. For example, if the entire refrigeration capacity of a freezer is not required, the cryogen input to the last and second to last cooling zones can be reduced if desired.

Figure 7:
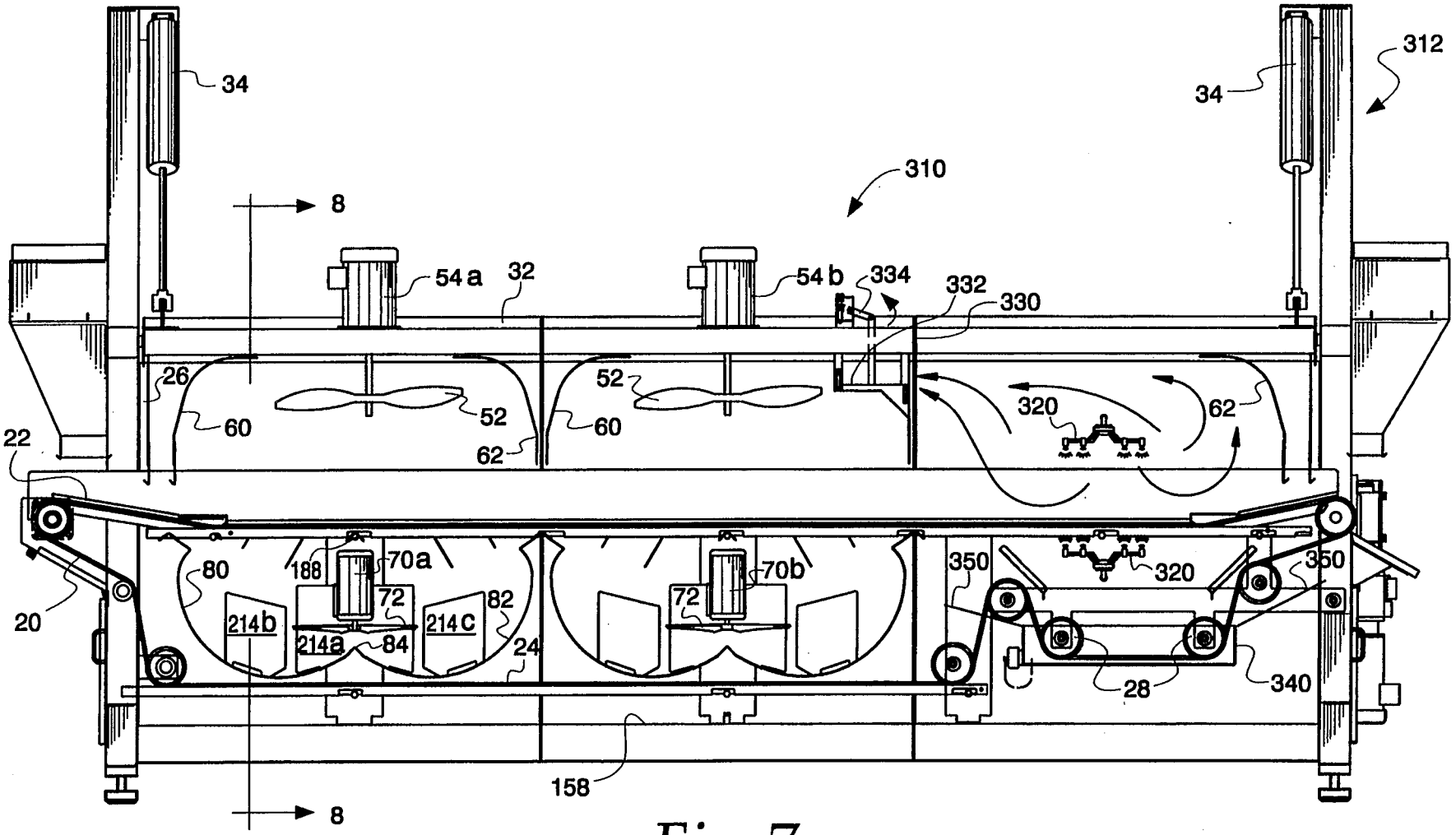
FIG. 7 is a further alternative embodiment of a tunnel freezer, illustrating principles according to the present invention.
Figure 8:
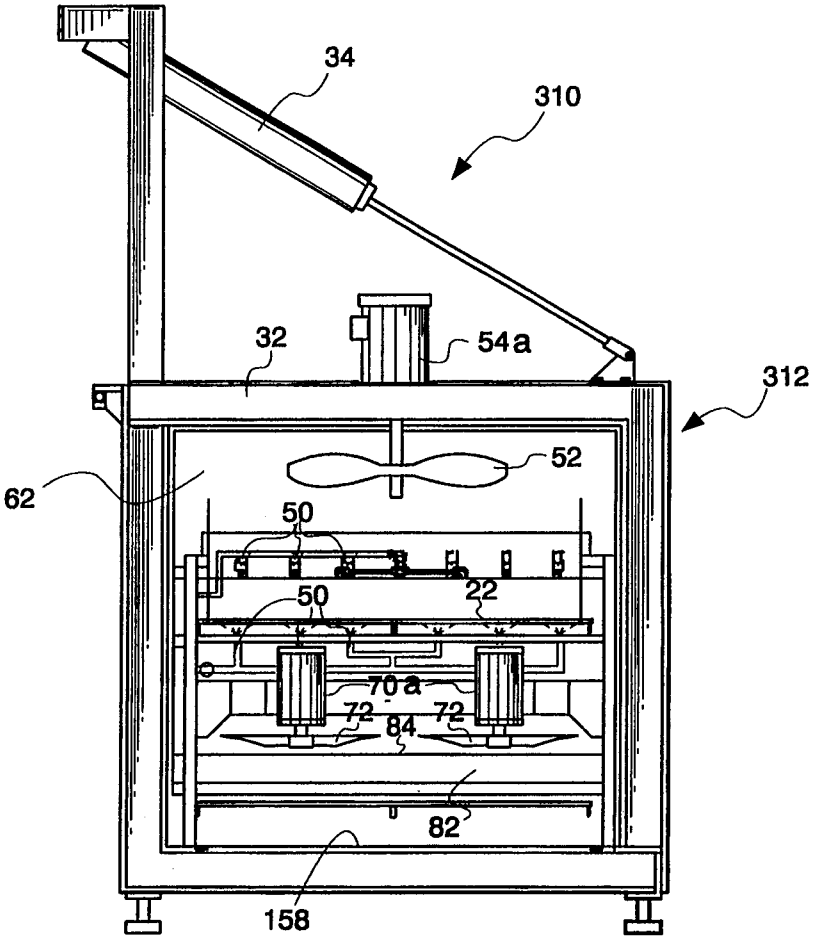
FIG. 8 is a cross-sectional view taken along the line 8—8 of FIG. 7.

Referring now to FIGS. 7 and 8, another alternative embodiment of a freezer constructed according to principles of the present invention is generally indicated at 310. The freezer 310 has three cooling zones, as in the embodiment immediately preceding, and the housing 312 is substantially identical to the housing 212. The first two cooling zones are shown without coolant injection, and the third cooling zone is shown with a liquid nitrogen (or other liquid cryogen) spray rather than $CO_2$ snow injection. Liquid nitrogen spray nozzles 320 are located above conveyor belt 20. Spray from nozzles 320 impinges directly on product carried on upper belt run 22, providing a final cooling for the product before exiting freezer 310. If desired, an optional lower spray 320 can be added, in the manner shown in FIG. 7.

A portion of the liquid nitrogen vapor exiting the upper nozzles 320 remains in suspension above the upper belt run 22. The two upstream stages can be operated with a liquid cryogen spray, or with mechanical refrigeration, and in many commercial freezer constructions, the entry cooling stage may be operated at a lower pressure than subsequent cooling stages. For example, in many practical freezer constructions, contact between the entry curtain 26 and product must be avoided, thereby resulting in a gap at the entrance end of the freezer through which internal freezer pressure is relieved. With the arrangement shown in FIG. 7, nitrogen vapor in the final cooling stage is induced to travel toward the entrance end of the freezer. In order to enhance cooling efficiency, the partition 330 located between the second and third cooling zones has a window or aperture formed therein so that vapor can enter a gate valve 332 operated by linkage 334, so as to pass into the middle cooling zone, at the section side of fan blades 52.

As mentioned above, the third cooling zone of freezer 310 may include an optional lower liquid nitrogen spray assembly 320, upwardly directed toward product carried on the upper run of conveyor belt 20. It has been found desirable to provide a collection pan 340 to collect liquid nitrogen which has not sublimed and which has not been carried away by circulation currents to pass into the middle cooling zone. Additional guide rollers 28 direct a portion of the conveyor belt run through the collection pan 340. When substantial amounts of liquid nitrogen are accumulated in the collection pan, a cryogen bath is provided for precooling of the belt. This has been found to provide several advantages in freezer operation. For example, warm products release more quickly from the belt when belt precooling is provided. In FIG. 7, additional collection trays 350 are provided on the upstream and downstream ends of collection pan 340. However, the collection trays 350 can be omitted if desired.

The drawings and the foregoing descriptions are not intended to represent the only forms of the invention in regard to the details of its construction and manner of operation. Changes in form and in the proportion of parts, as well as the substitution of equivalents, are contemplated as circumstances may suggest or render expedient; and although specific terms have been employed, they are intended in a generic and descriptive sense only and not for the purposes of limitation, the scope of the invention being delineated by the following claims.

What is claimed is:

1. Freezer apparatus, comprising a tunnel enclosure;

a perforate conveyor belt for transporting products, having at least an upper conveyor belt run and extending through the tunnel enclosure and having upper and lower runs;

an upper fan in the tunnel enclosure above the upper conveyor belt run and having a downward discharge directed toward the upper conveyor belt run;

spray means in the tunnel enclosure above the upper conveyor belt run, for spraying particles of heat transfer material onto products carried on the upper conveyor belt run;

a lower fan in the tunnel enclosure below the upper conveyor belt run and having a downward discharge directed away from the upper conveyor belt run;

a curved deflector member at least partly located below the lower fan, directing at least a portion of the discharge of the lower fan along the underside of the upper conveyor belt run; and a turning vane means located below the upper conveyor belt run for directing the portion of the discharge of the lower fan flowing along the underside of the upper conveyor belt run in a generally upward direction.

2. The apparatus of claim 1 wherein said spray means comprises means for injecting carbon dioxide in the form of snow particles.

3. The apparatus of claim 1 wherein said curved deflector member is comprised of two portions arranged side-by-side and meeting at a ridge which has a cusp shape in cross section.

4. The apparatus of claim 1 further including a flow-deflecting curtain at least partly surrounding said upper fan.

5. The apparatus of claim 1 wherein said upper fan and said lower fan are aligned along a common axis.

6. The apparatus of claim 1 further including a second lower fan in the tunnel enclosure below the upper conveyor belt run to one side of said one lower fan and having a downward discharge directed away from the upper conveyor belt run, toward said curved deflector member.

7. The apparatus of claim 5 further including baffle means between said lower fans.

8. The apparatus of claim 6 wherein said upper fan and said lower fans lie in a common vertical plane passing through said belt so as to be generally perpendicular to the path of belt travel.

9. The apparatus of claim 1 wherein said turning vane means comprise a deflecting member on upstream and downstream sides of said lower fan.

10. The apparatus of claim 1 wherein said turning vane means comprise a plurality of pivotally deflecting members on upstream and downstream sides of said lower fan.

11. The apparatus of claim 10 wherein said deflecting members on each side of said lower fan are of generally different lengths.

12. The apparatus of claim 1 further including a liquid spray zone in said tunnel enclosure downstream of said upper fan, said liquid spray zone including at least one spray nozzle for spraying a cryogenic liquid onto products carried on said upper conveyor belt run.

13. The apparatus of claim 12 further including a barrier between said upper fan and said liquid spray zone, with an opening for a cryogenic liquid spray in said liquid spray zone to be induced by said upper fan for impingement on product carried on said upper conveyor belt run.

14. The apparatus of claim 12 further including a pan for collecting cryogenic liquid to form a cryogenic liquid bath, and means for directing at least a portion of said upper conveyor belt run through said cryogenic liquid bath.

15. Freezer apparatus, comprising a tunnel enclosure;

a perforate endless conveyor belt for transporting products, having at least an upper conveyor belt run and extending through the tunnel enclosure and forming an endless loop with spaced apart upper and lower conveyor runs;

a series of cooling zones within the tunnel enclosure extending along the conveyor belt, each cooling zone including spray means in the tunnel enclosure above the upper conveyor belt run, for spraying particles of heat transfer material onto products carried on the upper conveyor belt run and an upper fan in the tunnel enclosure above the upper conveyor belt run and having a downward discharge directed toward the upper conveyor belt run;

each cooling zone further including a lower fan in the tunnel enclosure between the upper and lower conveyor runs, and the lower fan having a downward discharge directed away from the upper conveyor belt run;

each cooling zone further including a curved deflector member located below the lower fan between the upper and lower conveyor runs, with the curved deflector member directing at least a portion of the discharge of the lower fan along the underside of the upper conveyor belt run; and each cooling zone further including a turning vane located below the upper conveyor belt run to direct the portion of the discharge of the lower fan flowing along the underside of the upper conveyor belt run in a generally upward direction.

16. The apparatus of claim 15 wherein said spray means comprises means for injecting carbon dioxide in the form of snow particles.

17. The apparatus of claim 15 wherein said curved deflector member of at least one cooling zone is comprised of two portions arranged side-by-side and meeting at a ridge which has a cusp shape in cross section.

18. The apparatus of claim 15 further including a flow-deflecting curtain at least partly surrounding said upper fan of at least one cooling zone.

19. The apparatus of claim 15 wherein said upper fan and said lower fan of at least one cooling zone are aligned along a common axis.

20. The apparatus of claim 15 further including in at least one cooling zone a second lower fan in the tunnel enclosure below the upper conveyor belt run to one side of said one lower fan and having a downward discharge directed away from the upper conveyor belt run, toward said curved deflector member.

21. The apparatus of claim 19 further including baffle means between said lower fans of at least one cooling zone.

22. The apparatus of claim 20 wherein said upper fan and said lower fans of at least one cooling zone lie in a common vertical plane passing through said belt so as to be generally perpendicular to the path of belt travel.

23. The apparatus of claim 15 wherein said turning vane means of at least one cooling zone comprise a deflecting member on upstream and downstream sides of said lower fan.

24. The apparatus of claim 15 wherein said turning vane means of at least one cooling zone comprise a plurality of deflecting members on upstream and downstream sides of said lower fan.

25. The apparatus of claim 24 wherein said deflecting members on each side of said lower fan are of generally different lengths.

26. The apparatus of claim 15 further including a liquid spray zone in said tunnel enclosure downstream of one said upper fan in one said cooling zone, said liquid spray zone including at least one spray nozzle for a cryogenic liquid onto products carried on said upper conveyor belt run.

27. The apparatus of claim 26 further including a barrier between said one upper fan and said liquid spray zone, with an opening for a cryogenic liquid spray in said liquid spray zone to be induced by said one upper fan for impingement on product carried on said upper conveyor belt run.

28. The apparatus of claim 26 further including a pan for collecting cryogenic liquid to form a cryogenic liquid bath, and means for directing at least a portion of said conveyor belt through said cryogenic liquid bath.

29. A method of cooling products carried along a perforate endless conveyor belt having at least an upper conveyor belt run and travelling through a tunnel enclosing a cooling environment, comprising the steps of:

spraying carbon dioxide snow downwardly onto products carried on the upper conveyor belt run;

blowing the carbon dioxide snow downwardly through the upper conveyor belt run and also onto products carried on the upper conveyor belt run;

blowing the carbon dioxide snow passing downwardly through the upper conveyor belt run, downwardly away from the upper conveyor belt run;

deflecting the carbon dioxide snow along the underside of the upper conveyor belt run; and deflecting the carbon dioxide snow upwardly toward the underside of the upper conveyor belt run.

30. The method of claim 29 further comprising the steps of spraying a liquid heat transfer material toward products carried on the upper conveyor belt run;

collecting liquid heat transfer material not carried away by the products to form an immersion bath; and passing at least a portion of the conveyor belt through the immersion bath to cool the conveyor belt.

31. The method of claim 30 further comprising the step of mixing a portion of the heat transfer material not carried away by the products with the carbon dioxide snow and blowing the mixture onto products carried by the upper conveyor belt run.

32. The method of claim 31 wherein the heat transfer material comprises liquid nitrogen.

* * * * *